United States Patent [19]

Yamagishi et al.

[11] Patent Number: 4,643,092

[45] Date of Patent: Feb. 17, 1987

[54] EASY-TO-CLEAN INKING MECHANISM FOR A PRINTING PRESS

[75] Inventors: Kenich Yamagishi, Yachiyo; Katsuyuki Mori, Tokyo, both of Japan

[73] Assignee: Miyakoshi Printing Machinery Co., Ltd., Tokyo, Japan

[21] Appl. No.: 828,739

[22] Filed: Feb. 12, 1986

[51] Int. Cl.[4] ..... B41F 35/04; B41F 31/10

[52] U.S. Cl. ..... 101/350; 101/425

[58] Field of Search ..... 101/425, 350, 349, 351, 101/352, DIG. 6, 148, 207–210; 15/256.52

[56] References Cited

U.S. PATENT DOCUMENTS

| | | | |
|---|---|---|---|
| 3,771,450 | 11/1973 | Cleybergh | 15/256.52 |
| 3,911,815 | 10/1975 | Banfer | 101/350 X |
| 3,976,007 | 8/1976 | Junghans et al. | 101/425 |
| 4,072,106 | 2/1978 | Junghans et al. | 101/425 |

*Primary Examiner*—J. Reed Fisher

*Attorney, Agent, or Firm*—Vorys, Sater, Seymour & Pease

[57] ABSTRACT

A printing press inking mechanism comprising a fountain roller dipped in a printing ink in an ink fountain, and a drawout roller movable alternately into and out of rolling engagement with the fountain roller and a first of a series of ink rollers for ink transfer from the former to the latter and then to a plate cylinder. The drawout roller when in rolling engagement with the first of the ink rollers can be revolved therewith and so can be automatically cleaned therewith clean of the printing ink by a solvent. The fountain roller has so far been left out of rotation, requiring manual cleaning. Thus a cleaning roller is additionally provided which is movable, at the time of the cleaning of the rollers, into rolling engagement with both the fountain roller and the drawout roller to transmit the rotation of the ink rollers to the fountain roller, so that the fountain roller can also be automatically cleaned with the other rollers.

2 Claims, 2 Drawing Figures

EASY-TO-CLEAN INKING MECHANISM FOR A PRINTING PRESS

BACKGROUND OF THE INVENTION

Our invention relates to an inking mechanism for printing presses such as a rotary relief press, and more specifically to such an inking mechanism designed for the ease of the cleaning of its constituent rollers.

As is well known, the printing ink is transferred from an ink fountain to the plate cylinder via a succession of rollers (see FIG. 1 of the drawings attached hereto). The rollers include a fountain roller dipped in the ink fountain, and a drawout roller alternately movable into rolling engagement with the fountain roller and the first of a series of ink rollers. A problem with such a printing press inking mechanism, as heretofore constructed, has been the cleaning of the inking rollers. All the inking rollers must be washed clean of the printing ink as for a change of colors or when the press is to be held out of operation for an extended period of time. The resulting downtime of the printing press has been substantial, particularly for the sheet fed machine that requires a frequent change of ink colors.

The conventional cleaning practice has been to jointly revolve all but the fountain roller of the inking rollers and to apply a solvent onto the revolving rollers. Dissolved by the solvent, the printing ink flows from one roller to another to be doctored off one of the rollers adjacent the plate cylinder. All but the fountain roller of the inking rollers have thus be capable of cleaning automatically. The fountain roller has been incapable of automatic cleaning with the other rollers because it has been held out of rolling engagement therewith. Accordingly, for cleaning the fountain roller, the printing ink has first been drained from the fountain, and the roller has been manually wiped as with a doctor or with a piece of cloth impregnated with a solvent, at the cost of considerable time and labor.

SUMMARY OF THE INVENTION

We have hereby solved the problem of how to automatically clean the fountain roller of the printing press inking mechanism together with the other rollers by simple means that can be compactly incorporated with the printing press so as not to interfere with its normal operation in any way.

Stated briefly, the improved inking mechanism in accorddance with out invention comprises a fountain roller disposed in an ink fountain to be dipped in printing ink contained therein. A drawout roller is movable alternately into and out of rolling engagement with the fountain roller and with the first of a series of ink rollers for ink transfer from the former to the latter, the first ink roller being disposed with a spacing from the fountain roller. Also included is a cleaning roller movable into and out of simultaneous rolling engagement with both the fountain roller and the drawout roller.

Thus, when moved into rolling engagement with both the fountain roller and the drawout roller, the cleaning roller is effective to cause joint rotation of the fountain roller with the drawout roller and the series of ink rollers. It is therefore possible to clean the fountain roller simultaneously with the drawout roller and the ink rollers and in the same way as the drawout roller and the ink rollers have been cleaned heretofore. No extra trouble is involved, moreover, in so cleaning the fountain roller other than that of activating, as by a fluid actuated cylinder, the cleaning roller into rolling contact with the fountain roller and the drawout roller. The fluid actuated cylinder and associated supporting means for the cleaning roller can be compactly built into the conventional inking mechanism without any major alteration of the existing parts.

The above and other features and advantages of our invention and the manner of realizing them will become more apparent, and the invention itself will best be understood, from a study of the following description and appended claims, with reference had to the attached drawings showing a preferred embodiment of our invention.

DETAILED DESCRIPTION

Figure 1:
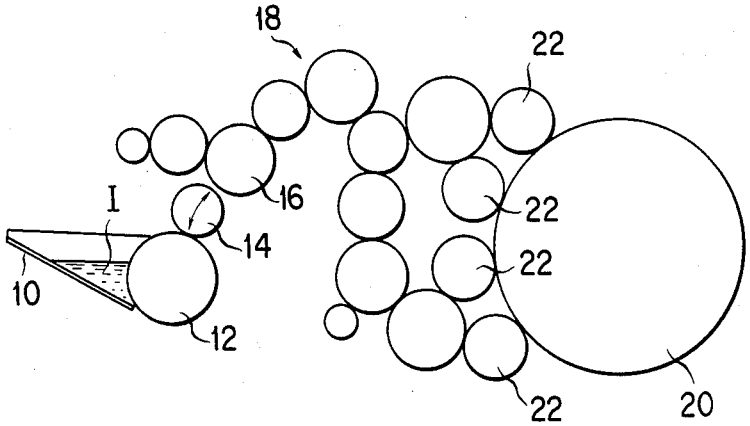
FIG. 1 PRIOR ART
FIG. 1 is a diagrammatic side elevation of a typical prior art inking mechanism for a rotary printing press.

We will first describe in some more detail the typical prior art inking mechanism of FIG. 1 for a better understanding of our invention. At 10 is shown an ink fountain containing a supply of printing ink I. A fountain roller 12 is dipped in the printing ink I in the ink fountain 10. A drawout roller 14 is alternately movable into rolling engagement with the fountain roller 12 and the first 16 of a series of ink rollers 18 leading to a plate cylinder 20. The ink rollers include form rollers 22 in direct rolling engagement with the plate cylinder 20. Traveling alternately into rolling engagement with the fountain roller 12 and the first ink roller 16, the drawout roller 14 draws the printing ink I from the surface of the fountain roller and transfers the ink on to the subsequent series of ink rollers and thence to the plate cylinder 20.

The fountain roller 12 has been neither provided with its own drive means for rotation nor has been capable of joint rotation with the other rollers during the cleaning of such rollers. We have already pointed out the inconveniences arising from this conventional arrangement.

Figure 2:
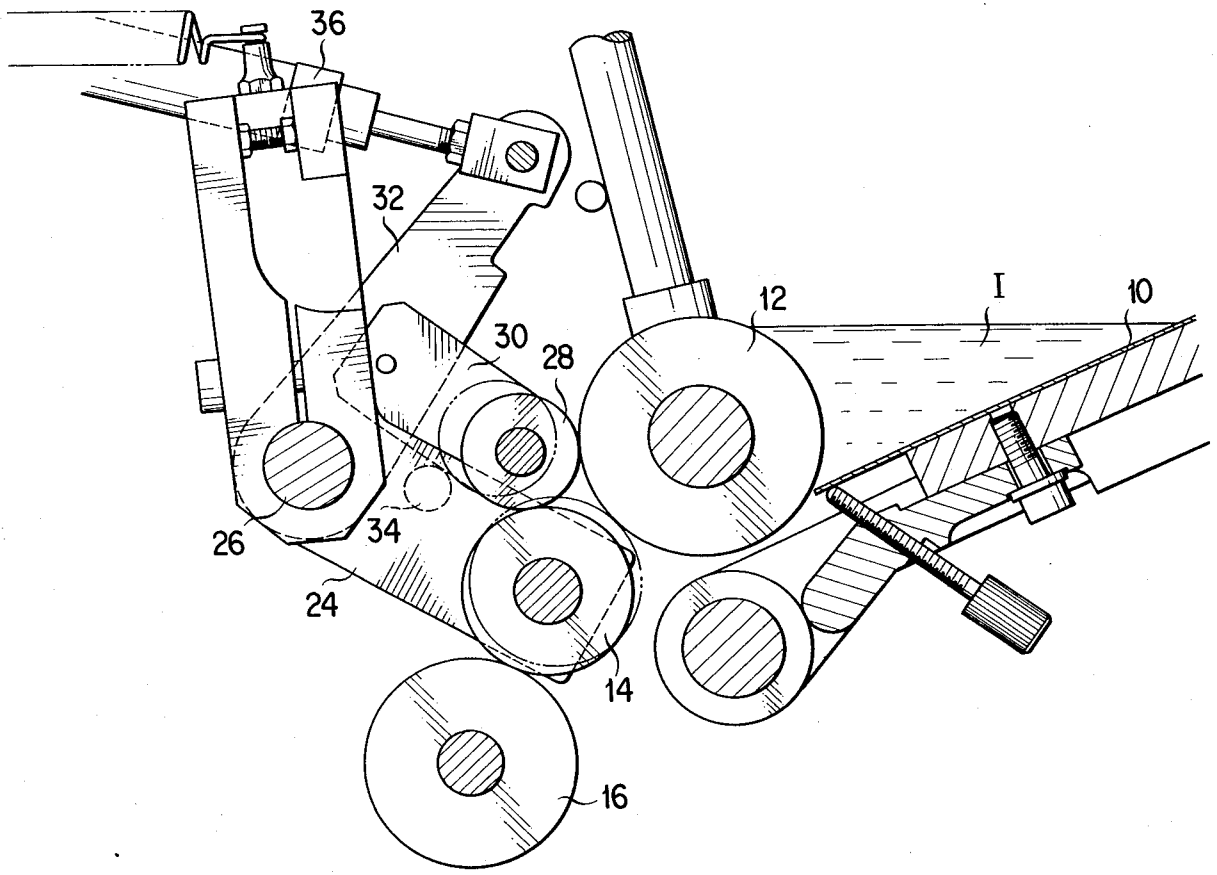
FIG. 2 is a fragmentary vertical section through the improved inking mechanism constructed in accordance with the novel concepts of our invention.

In FIG. 2 we have shown fragmentarily the improved inking mechanism of our invention. Like the prior art of FIG. 1 the improved inking mechanism also comprises the fountain roller 12 dipped in the printing ink I in the fountain 10, and the drawout roller 14. In this drawing, however, we have shown only the first 16 of the series of ink rollers because the other ink rollers can be arranged as in FIG. 1, although FIG. 1 depicts but one of numerous possible arrangements of such ink rollers. The first ink roller 16 is disposed opposite the fountain roller 12 with a spacing such that the drawout roller 14 is movable alternately into rolling engagement with the fountain roller and the first ink roller, as indicated by the solid and phantom lines. For such reciprocating movement the drawout roller 14 has its opposite ends rotatably supported by a pair of bell cranks 24 (one seen). These bell cranks 24 are both medially pivoted on a fixed shaft 26 parallel to the various rollers of the inking mechanism.

At 28 we have shown a cleaning roller forming the gist of our invention. Disposed opposite the fountain roller 12 and the drawout roller 14, the cleaning roller 28 has its opposite ends rotatably carried by and between the dital ends of a pair of support arms 30 (one seen). The support arms 30 are proximally anchored to the midpoints of a pair of levers 32 which are mounted on the shaft 26 for joint swinging motion. A fixed abutment such as a pin 34 is disposed under the support arms 30 for limiting their displacement. The free ends of the levers 32 are operatively coupled to a fluid actuated cylinder 36, preferably an air cylinder. Thus, with the extension and contraction of this cylinder 36, the cleaning roller 28 is movable into and out of simultaneous rolling engagement with the fountain roller 12 and the drawout roller 14.

During the normal printing operation, the fluid actuated cylinder 36 may be held contracted to hold the cleaning roller 28 out of contact with both the fountain roller 12 and the drawout roller 14, as indicated by the phantom lines in FIG. 2. Then, with the drawout roller 14 reciprocated into alternate rolling engagement with the fountain roller 12 and the first ink roller 16 by conventional means, the printing ink I will be supplied to the plate cylinder in the normal manner.

For cleaning the improved inking mechanism of FIG. 2, the printing ink I may be drained from the fountain 10, and the cylinder 36 may be extended to move the cleaning roller 28 into rolling engagement with both the fountain roller 12 and the draw-out roller 14, the latter being now in contact with the first ink roller 16, as pictured by the solid lines. It will be seen that the fountain roller 12 has now been rotatably engaged with all the other rollers of the inking mechanism via the cleaning roller 28. The fountain roller 12 will therefore revolve with the other rollers as the inking mechanism is driven by the unshown conventional drive means. A suitable ink solvent may now be applied to the revolving rollers. Dissolved by the solvent, the ink will travel from one roller to another until it is doctored off a roller in the vicinity of the form rollers.

We would like to point out that any oversupply of an ink solvent is inadvisable. With an excessive supply of the solvent, the rollers might slip with respect to one another and so fail to revolve altogether. Although the illustrated embodiment will operate satisfactorily with a due supply of the solvent, it may also be contemplated to directly connect one or more of the fountain roller 12, drawout roller 14 and cleaning roller 28 to a drive source, thereby forcibly driving the roller or rollers against the possibility of slippage.

It is to be understood that we have chosen the foregoing embodiment merely to illustrate or explain our invention and not to impose limitations thereon. A variety of roller arrangements, a variety of cleaning roller supporting and actuating means, and a host of other modifications or alterations of the above embodiment are possible without departing from the scope of our invention as explained in the following claims.

We claim:

1. An inking mechanism for a printing press comprising:

(a) an ink fountain for containing a printing ink;

(b) a fountain roller disposed in the ink fountain to be dipped in the printing ink;

(c) a series of ink rollers including a first ink roller disposed opposite the fountain roller with a spacing therebetween;

(d) a drawout roller movable alternately into and out of rolling engagement with the fountain roller and with the first ink roller for ink transfer from the former to the latter; and (e) a cleaning roller movable into and out of simultaneous rolling engagement with both the fountain roller and the drawout roller, the cleaning roller when in rolling engagement with the fountain roller and the drawout roller being effective to cause joint rotation of the fountain roller with the drawout roller and the series of ink rollers and hence to make possible the cleaning of the fountain roller simultaneously with the drawout roller and the ink rollers.

2. The inking mechanism of claim 1 further comprising means for moving the cleaning roller into and out of simultaneous rolling engagement with the fountain roller and the drawout roller, the moving means comprising a pair of support levers pivotable abound a common axis and rotatably carrying the cleaning roller, and an actuator for pivoting the support levers.

* * * * *